US007341494B2

(12) United States Patent
Wang

(10) Patent No.: US 7,341,494 B2
(45) Date of Patent: Mar. 11, 2008

(54) LOW PROFILE CONNECTOR

(75) Inventor: Shi-Yong Wang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/286,591

(22) Filed: Nov. 23, 2005

(65) Prior Publication Data

US 2006/0110985 A1 May 25, 2006

(30) Foreign Application Priority Data

Nov. 25, 2004 (CN) ..... 2004 1 00653678

(51) Int. Cl.
*H01R 13/64* (2006.01)

(52) U.S. Cl. ..... 439/680; 439/83; 439/607

(58) Field of Classification Search ..... 439/83, 439/607, 680

See application file for complete search history.

(56) References Cited

U.S. PATENT DOCUMENTS

| | | | | |
|---|---|---|---|---|
| 6,302,744 | B1 * | 10/2001 | Nomura | 439/680 |
| 6,699,049 | B1 * | 3/2004 | Wu | 439/79 |
| 6,702,620 | B2 * | 3/2004 | Lynch et al. | 439/638 |
| 2006/0110985 | A1 * | 5/2006 | Wang | 439/680 |

* cited by examiner

*Primary Examiner*—James R. Harvey
(74) *Attorney, Agent, or Firm*—Wei Te Chung

(57) ABSTRACT

A low profile connector (1) includes an insulative housing (2) having an opening (221) surrounded by an upper wall (20), a lower wall (21), a pair of opposed side walls (23) and a back wall (24). A plurality of contacts (3) is assembled with the back wall for being fastened with the housing. The back wall defines at least one protrusion (25) extending into the opening. The protrusion is dissymmetrical about a plane perpendicular to the back wall.

5 Claims, 4 Drawing Sheets

LOW PROFILE CONNECTOR

BACKGROUND OF THE INVENTION

1. Field of the Invention

The invention relates to a low profile connector, especially to a low profile connector having anti-mismatching structures.

2. Description of the Related Arts

Electrical connectors are widely used in mobile phones, key boards and hard disk drivers. Small sizes are required for the connectors to meet the reduced sizes of the equipments said above. The low profile connectors are used for connecting with other mating connectors to achieve electrical connection between the equipments and external components.

A housing of he low profile connector is generally made of plastic and has poor strength because of small size. Thus, the connector is easily to be damaged if a mating component mates with the connector by improper manner. For instance, engaging the low profile connector with the external component in a reversed direction will break the housing of the low profile connector.

In view of the above, what is needed is a low profile connector having means for preventing the connector from being engaged with other mating component in a reversed direction.

SUMMARY OF THE INVENTION

According to the present invention, an improved low profile connector is provided to resolve the disadvantage described above. The low profile connector includes an insulative housing having an opening surrounded by an upper wall, a lower wall, a pair of opposed side walls and a back wall. A plurality of contacts is assembled with the back wall for being fastened with the housing. The back wall defines at least one protrusion extending into the opening. The protrusion is dissymmetrical about a plane perpendicular to the back wall.

For the protrusion in the opening is dissymmetrical about a plane perpendicular to the back wall, the mating component can not engage with the low profile connector if the mating component is reversed.

Other advantages and novel features of the present invention will become more apparent from the following detailed description when taken in conjunction with the accompanying drawings, in which:

DESCRIPTION OF PREFERRED EMBODIMENT

Hereinafter, a preferred embodiment of the invention will be described in detail with reference to the attached drawings.

Figure 1:
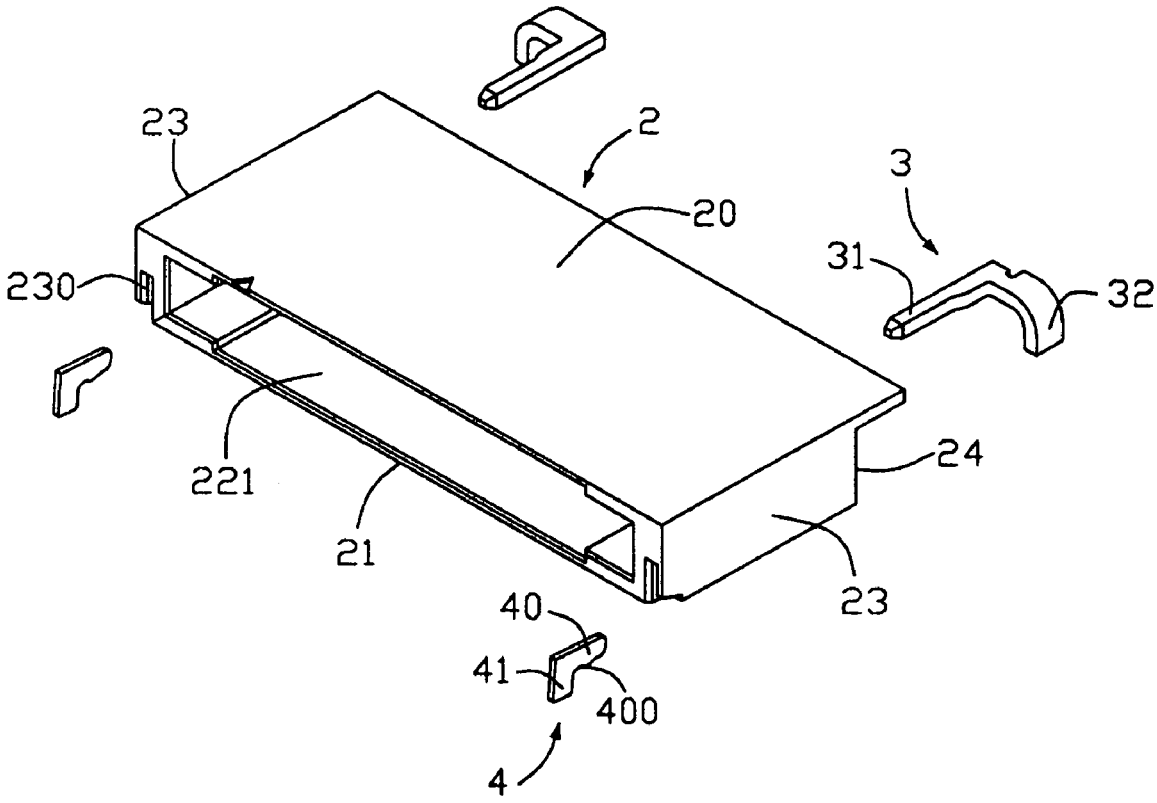
FIG. 1 is an exploded isometric view of a low profile connector in accordance with a preferred embodiment of the present invention.
Figure 2:
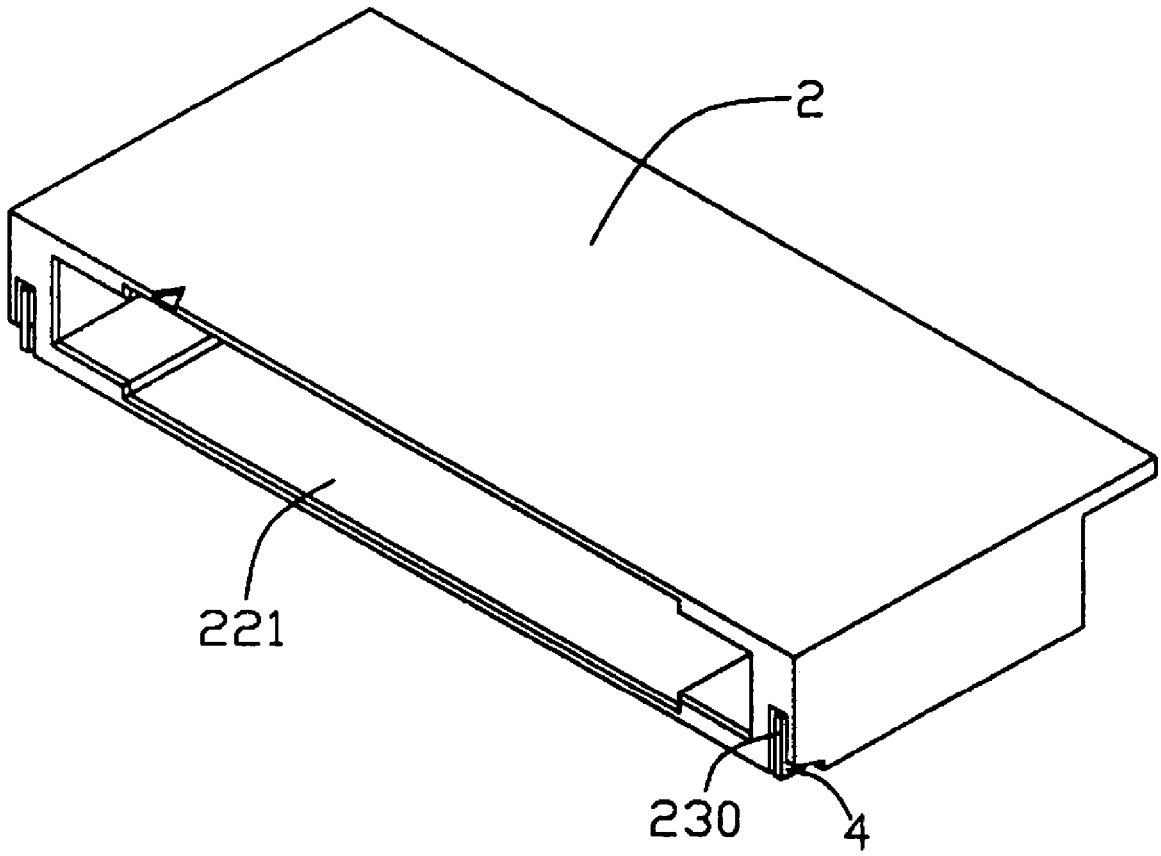
FIG. 2 is an assembled view of FIG. 1.
Figure 3:
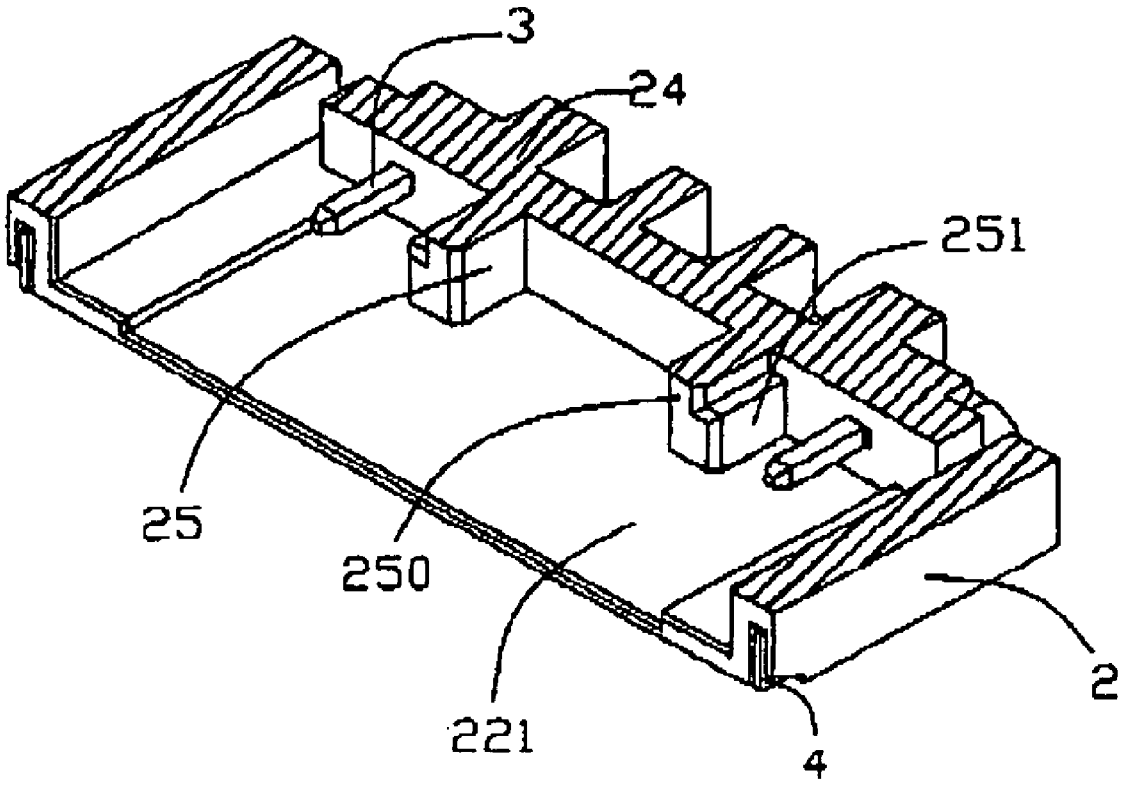
FIG. 3 is an assembled view of FIG. 1, a housing of the connector being partially cut away by a plane perpendicular to the back wall.
Figure 4:
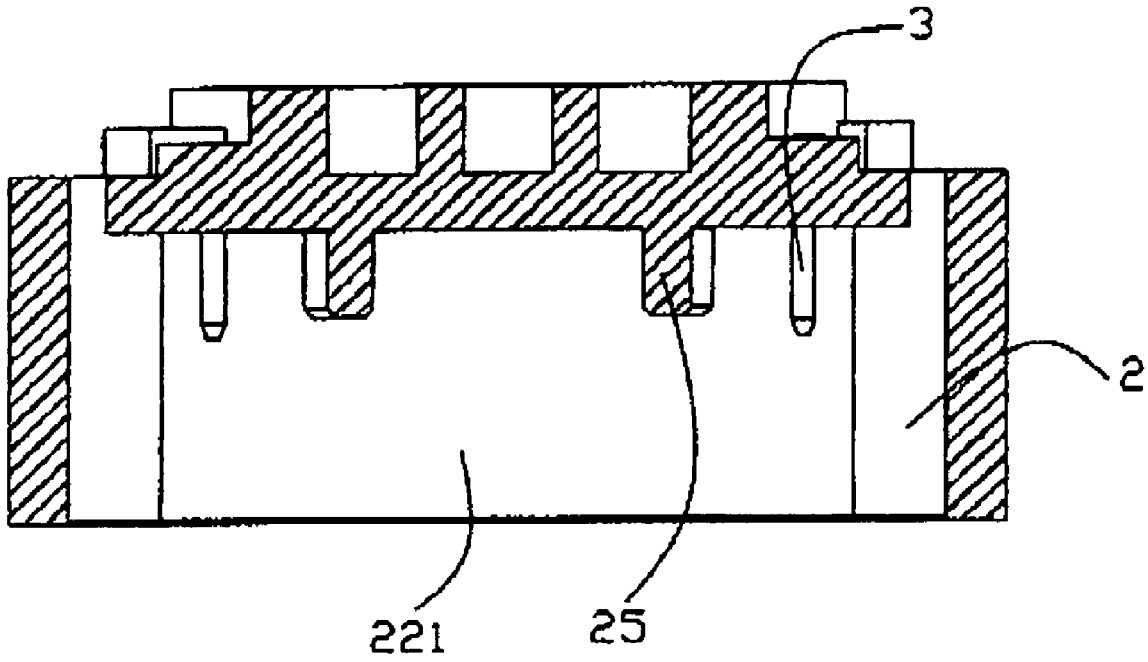
FIG. 4 is a top view of FIG. 3.

Referring to FIGS. 1-4, a low profile connector 1 in accordance with the preferred embodiment includes an insulative housing 2, a plurality of contacts 3 assembled with the housing, and a plurality of metal ears 4 assembled with the housing 2. The housing defines an opening 221 surrounded by an upper wall 20, a lower wall 21, a pair of opposed side walls 23 and a back wall 24.

The contacts 3 are assembled with the housing 2 by being interferentially engaged with the back wall 24. Each of the side wall 23 defines a slot 230 therein, and the metal ears 4 are received in the slots 230.

The back wall 24 defines at least one protrusion 25 extending into the opening 221. The protrusion 25 is dissymmetrical about a plane perpendicular to the back wall 24. In this embodiment, the back wall 24 defines two separated protrusions 25. And each of the protrusion 25 defines an upper portion 250 and a lower portion 251. A width of the upper portion 250 is not the same as that of the lower portion 251. Therefore, the protrusion 25 is substantially L-shaped.

The contact 3 is generally L-shaped. Each of the contact 3 includes a mating portion 31 engaging with the back wall 24 and a soldering portion 32 extending from a distal end of the mating portion 31. After the contact 3 is assembled with the housing 2, the mating portion 31 is partially received in the opening 221.

The metal ear 4 is also L-shaped. The metal ear 4 includes a fastening portion 40 received in the slot 230 and a mounting portion 41 extending from the fastening portion 40. The fastening portion 40 defines a plurality of barbs 400 for increasing interferential force.

As known, for mating with the low profile connector 1, the mating component must define a mating structure for engaging with the protrusion 25. As the protrusion 25 is dissymmetrical about a plane perpendicular to the back wall 24, the engagement between the low profile connector and the mating component cannot be achieved if the mating component is reversed.

In fact, to achieve the same performance, the back wall 24 can also defines two protrusions not symmetrical about a transverse central line of the housing 2.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A low profile connector for engaging with a mating component comprises:

an insulative housing defining an opening along a front-to-back direction and ended by a back wall and located above a bottom wall which is perpendicular to the end wall generally;

a plurality of contacts held by the housing and disposed in the opening; wherein said housing further defines a pair of protrusions disposed in the opening with corresponding L-shaped cross-sectional configurations, with regard to the front-to-back direction, opposite to each other; wherein the protrusions unitarily extend from both said end wall and said bottom wall.

2. The low profile connector as claimed in claim 1, wherein said pair of protrusions are dissymmetrical about a horizontal center plane of the opening, under a condition that said horizontal center plane is perpendicular to the back wall, to prevent the mating component from inserting reversedly during the mating compenent engagement with the connector.

3. The low profile connector as claimed in claim 1, wherein said pair of protrusions are distantly spaced from the corresponding contacts, respectively.

4. The low profile connector as claimed in claim 2, wherein the pair of protrusions are symmetrical to each other with regard to a vertical center plane of the opening which is perpendicular to said horizontal center plane.

5. The low profile connector as claimed in claim 1, wherein the contacts are only located by two sides of the pair of projections and there are no contacts located between said pair of protrusions.

* * * * *